US006214136B1

(12) United States Patent
Yoshimoto et al.

(10) Patent No.: US 6,214,136 B1
(45) Date of Patent: Apr. 10, 2001

(54) LIGHT-ALLOY CASTING HEAT TREATMENT METHOD

(75) Inventors: Kazuyuki Yoshimoto, Hiroshima-ken; Ryoji Abe, Higashi Hiroshima; Yukihiro Sugimoto, Higashi Hiroshima; Fuminori Ishimura, Higashi Hiroshima; Yukio Yamamoto, Hiroshima; Nobuyuki Oda, Hiroshima; Yukiyoshi Fukuda, Hiroshima; Toshio Miyatani, Hiroshima-ken; Hiroshi Kodama, Hiroshima; Akihiro Nakano, Kure, all of (JP)

(73) Assignee: Mazda Motor Corporation, Hiroshima (JP)

( * ) Notice: Subject to any disclaimer, the term of this patent is extended or adjusted under 35 U.S.C. 154(b) by 0 days.

(21) Appl. No.: 09/124,239

(22) Filed: Jul. 29, 1998

(30) Foreign Application Priority Data

Jul. 31, 1997 (JP) ..... 9-206738

(51) Int. Cl.[7] ..... C21D 1/613; C22F 1/04
(52) U.S. Cl. ..... 148/633; 148/693
(58) Field of Search ..... 148/633, 699

(56) References Cited

U.S. PATENT DOCUMENTS

| | | | |
|---|---|---|---|
| 4,313,772 | 2/1982 | Paulus . | |
| 4,931,108 | 6/1990 | Anzawa et al. . | |
| 5,681,407 * | 10/1997 | Yu et al. | 148/633 |

FOREIGN PATENT DOCUMENTS

| | | |
|---|---|---|
| 0 126 481 A2 | 11/1984 | (EP) . |
| 0 321 370 A1 | 6/1989 | (EP) . |
| 543 461 | 9/1922 | (FR) . |
| .2 133 047 | 7/1994 | (GB) . |
| 3-264655 | 11/1991 | (JP) . |
| 4-136141 | 5/1992 | (JP) . |
| WO 94/26939 | 11/1994 | (WO) . |

OTHER PUBLICATIONS

Shin Tsuchida, et al., Heat Treatment of Aluminum, pp. 28–45, (Apr. 1990).

Yasuhide Maekawa, et al., The Behavior of Surface Residual Stress Relief and Lattice Defect Density with Mechanical Vibration in FC25 Cast Iron, No. 85–1078 B, pp. 1295–1299, 1986.

Kent R. Van Horn, Aluminum, vol. III, Fabrication and Finishing, pp. 353–382, 1967.

Bates, C.E., "Selecting Quenchants to Maximize Tensile Properties and Minimize Distortion in Aluminium Parts", Journal of Heat Treating, New York, NY, USA, (1987), vol. 5, No. 1, pp. 27–40.

* cited by examiner

*Primary Examiner*—Sikyin Ip

(57) ABSTRACT

The film boiling state of a refrigerant is maintained for a time longer than in the prior art by t to lower the nuclear boiling start temperature to a temperature at which the material proof strength of a work exceeds thermal stress, thereby lowering the cooling rate of the work. In addition, by controlling the cooling rate in hardening, the film boiling state of the refrigerant is maintained to a temperature at which the material proof strength exceeds thermal stress, thereby cooling the work at a temperature equal to or higher than the critical cooling rate of the work.

11 Claims, 15 Drawing Sheets

LIGHT-ALLOY CASTING HEAT TREATMENT METHOD

BACKGROUND OF THE INVENTION

1. Field of the Invention

The present invention relates to a light-alloy casting heat treatment method and, more particularly, to a method of heat-treating a cylinder head consisting of an aluminum alloy.

2. Description of the Related Art

In the heat treatment of a light-alloy casting, a T6 process complying with JIS (Japanese Industrial Standard) is generally employed to largely increase the material strength. In the T6 process, a light-alloy casting (to be referred to as a work hereinafter) is heated at about 500° C. and held at this temperature for several hours. After this, the work is hardened in water at room temperature or warm water and held at about 180° C. for several hours.

However, since residual stress is generated in the work in hardening by the T6 process, the work cracks due to fatigue under a severe use environment.

The residual stress is traced back to temperature differences among different portions of the work. For example, during hardening, the cooling rate is high outside the work while it is low inside the work, and a temperature difference is generated between outside and inside the work. When the thermal stress due to this temperature difference exceeds the material proof strength of the work, residual stress is generated. Especially, because castings have complex shapes, the temperature readily varies locally, and the residual stress becomes high.

To reduce the residual stress, various methods have been proposed.

A polymer solution is used as a hardening refrigerant (Japanese Patent Application No. 2-62247).

The work shape or refrigerant circulation is improved to promote refrigerant supply to the work (Japanese Patent Laid-Open No. 4-136141).

The refrigerant temperature in hardening is increased (Sumitomo Light Metal Industries, Ltd., Technical Report Vol. 31, No. 2, 1990 (pp. 28–44).

The temperature in tempering is increased (Aluminum, Vol. 3, ASM (1967), 355).

Vibration is applied to the work after heat treatment (Papers of Japan Society of Mechanical Engineers, Vol. 52, No. 477, 1986, May).

However, these prior arts cannot sufficiently reduce the residual stress. Even if the residual stress can be reduced, the material strength lowers.

SUMMARY OF THE INVENTION

The present invention has been made to solve the above problem, and has as its object to provide a light-alloy casting heat treatment method capable of reducing residual stress in heat treatment without lowering the material strength of a light-alloy casting.

In order to solve the above problem and achieve the above object, according to the present invention, there is provided a light-alloy casting heat treatment method of heating a light-alloy casting to a predetermined hardening temperature and cooling the light-alloy casting using a refrigerant, comprising the steps of maintaining film boiling of the refrigerant at least to a temperature at which a proof strength of the casting exceeds thermal stress is reached.

Other objects and advantages besides those discussed above shall be apparent to those skilled in the art from the description of a preferred embodiment of the invention which follows. In the description, reference is made to accompanying drawings, which form a part thereof, and which illustrate an example of the invention. Such example, however, is not exhaustive of the various embodiments of the invention, and therefore reference is made to the claims which follow the description for determining the scope of the invention.

DETAILED DESCRIPTION OF THE PREFERRED EMBODIMENT

An embodiment of the present invention will be described below in detail with reference to the accompanying drawings.

[Principle of Hardening Method]

Figure 1A:
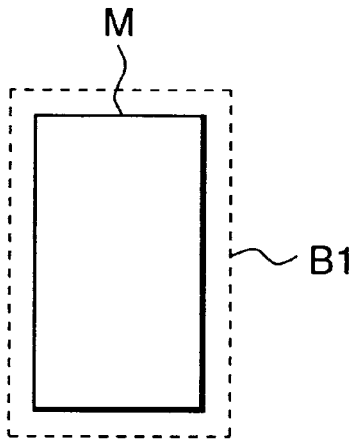
FIG. 1A is a view showing a refrigerant state which changes into a film boiling stage as a first stage.
Figure 1B:
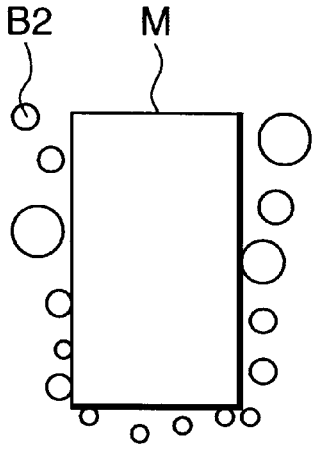
FIG. 1B is a view showing a refrigerant state which changes into a nuclear boiling stage as a second stage.
Figure 1C:
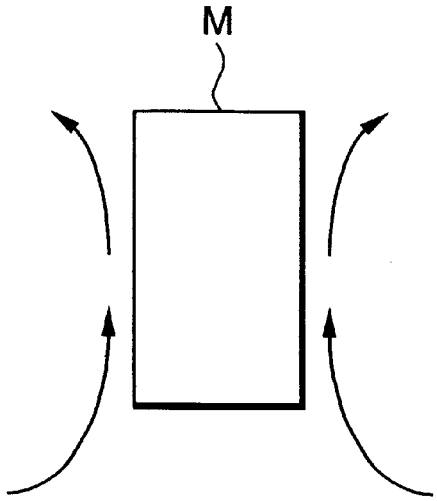
FIG. 1C is a view showing a refrigerant state which changes into a convection stage as a third stage.
Figure 2:
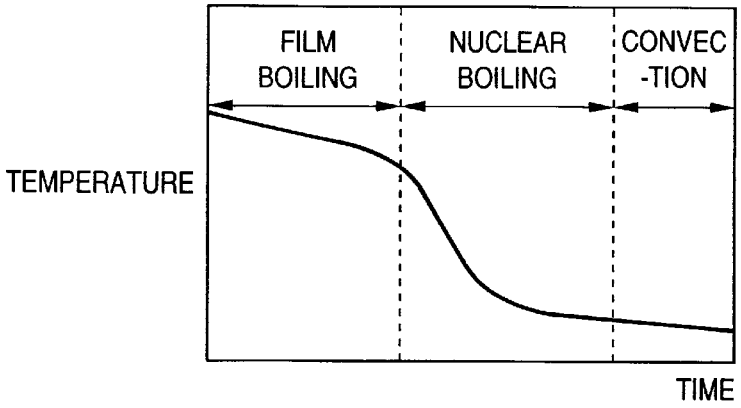
FIG. 2 is a graph showing the work cooling rate (temperature as a function of time) in accordance with the refrigerant state based on a prior art.
Figure 3:
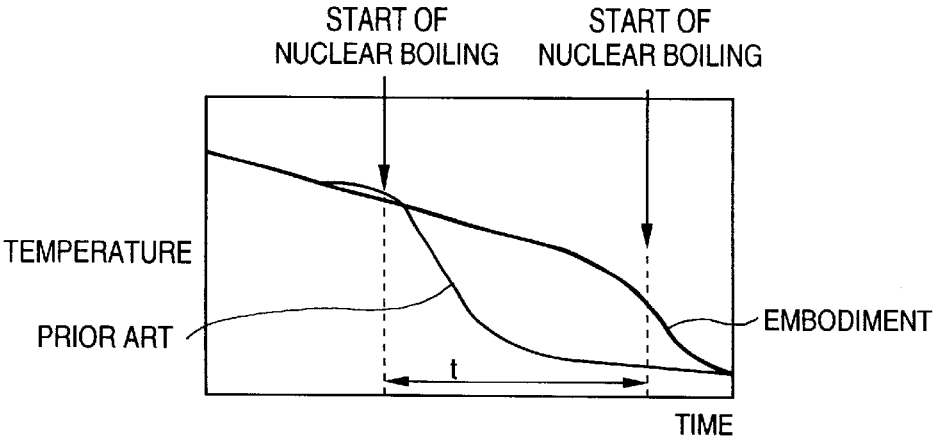
FIG. 3 is a graph showing the cooling rate upon hardening in an embodiment of the present invention.
Figure 4:
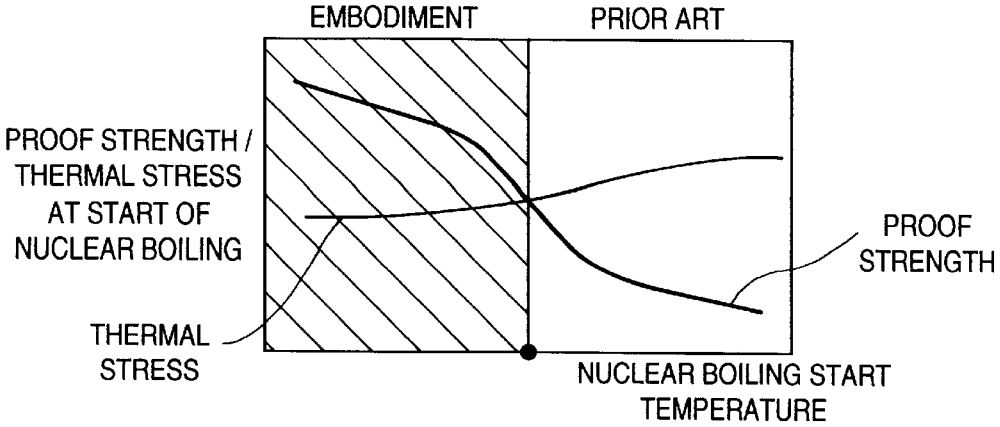
FIG. 4 is a graph showing the relationship between the proof strength and thermal stress at the nuclear boiling start temperature in the prior art and the embodiment.

FIGS. 1A to 1C are views showing the states of a refrigerant which changes in three stages. FIG. 2 is a graph showing the work cooling rate in accordance with the refrigerant state in the prior art. FIG. 3 is a graph showing the work cooling rate in hardening according to an embodiment of the present invention. FIG. 4 is a graph showing the relationship between the proof strength and thermal stress at the nuclear boiling start temperature in the prior art and the embodiment.

As shown in FIGS. 1A to 1C and 2, a work M consisting of a light-alloy casting or the like is hardened in three stages of cooling. The first stage is the film boiling stage (FIG. 1A), the second stage is the nuclear boiling stage (FIG. 1B), and the third stage is the convection stage (FIG. 1C). In the film boiling stage, a vapor film B1 of a refrigerant covers the work M, and the work M is uniformly cooled because of its low cooling rate. In the nuclear boiling stage, the vapor film B1 of the refrigerant is destroyed to form independent vapor bubbles B2. The work M rapidly cools down to generate temperature differences between different portions (e.g., outside and inside) of the work. When a thermal stress generated in the work M upon cooling at the nuclear boiling stage is higher than the material proof strength of the work M, plastic deformation occurs in the work to generate residual stress.

In this embodiment, taking this problem into consideration, the film boiling state of the refrigerant is maintained for a period longer than in the prior art by time t, as shown in FIG. 3. The nuclear boiling start temperature is lowered to a temperature at which the material proof strength of the work exceeds thermal stress, thereby lowering the work cooling rate.

The temperature at which the proof strength exceeds the thermal stress changes depending on the material used. For, e.g., an aluminum-alloy casting, the temperature is about 300° C. When the film boiling state is maintained to at least the temperature or lower temperature, nuclear boiling can be started after the material proof strength exceeds thermal stress, as shown in FIG. 4. Therefore, the residual stress in the work can be largely reduced.

In this embodiment, the cooling curve (temperature as a function of time) in hardening is controlled to maintain the film boiling state of the refrigerant to a temperature at which the material proof strength exceeds thermal stress and simultaneously cool the work at a rate higher than the critical cooling rate of the work. The critical cooling rate means a minimum necessary cooling rate for guaranteeing the material proof strength of the work in hardening. When the work is cooled at a rate lower than the critical cooling rate, the material proof strength of the work lowers.

The critical cooling rate also changes depending on the material used. For example, an AC4D material complying with JIS has a critical cooling rate of several ° C./s. By cooling the work at a rate higher than this cooling rate, the residual stress can be largely reduced without lowering the material proof strength.

[First Heat Treatment Method]

As described above, to maintain the film boiling state of the refrigerant and lower the nuclear boiling start temperature, it is effective to boil the refrigerant. However, when the refrigerant boils, the cooling rate lowers. For some materials, the cooling rate becomes lower than the critical cooling rate to lower the material proof strength. The cooling rate lowers because a film boiling state having a low cooling rate is maintained for a long time.

Figure 5:
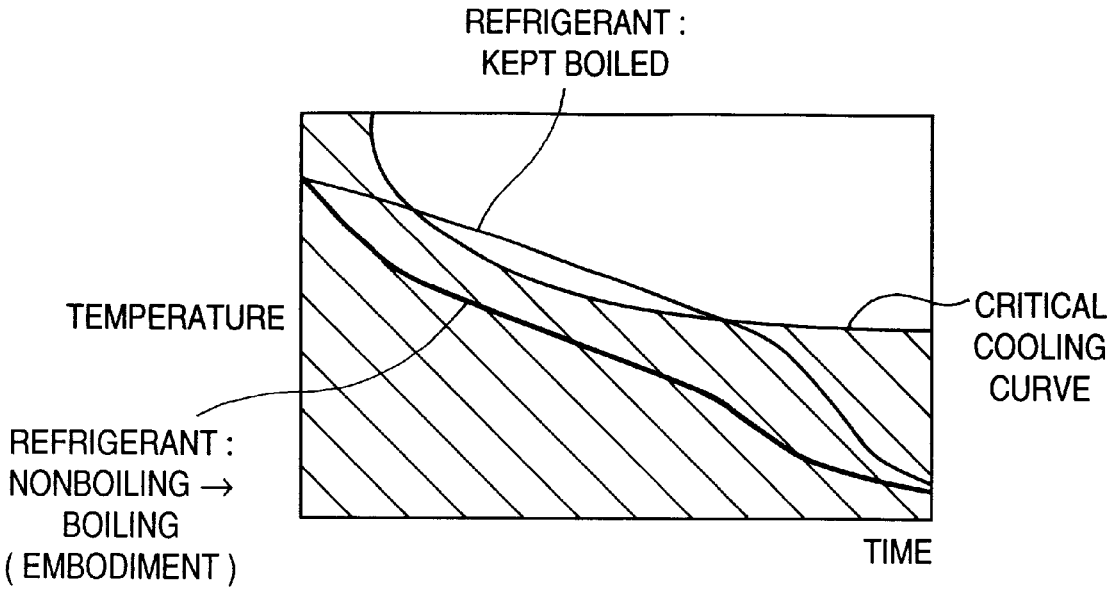
FIG. 5 is a graph showing the work cooling rate in hardening according to the first heat treatment method.

To prevent this, in this embodiment, the amount and initial temperature of the refrigerant are controlled such that the refrigerant boils after the work is put into the refrigerant, and the cooling rate at the initial stage of hardening is raised to maintain a cooling rate higher than the critical cooling rate, as shown in FIG. 5. The refrigerant may be boiled by the heat of the work itself. In this case, letting Q (kcal) be the amount of heat supplied from the work to the refrigerant, T0 (° C.) be the initial temperature of the refrigerant, T1 (° C.) be the boiling temperature, W (kg) be the amount of refrigerant, and C (kcal/kg ° C.) be the specific heat, the amount and initial temperature of the refrigerant preferably satisfy:

$$Q=(T1-T0)\times C\times W$$

[Second Heat Treatment Method]

Figure 6:
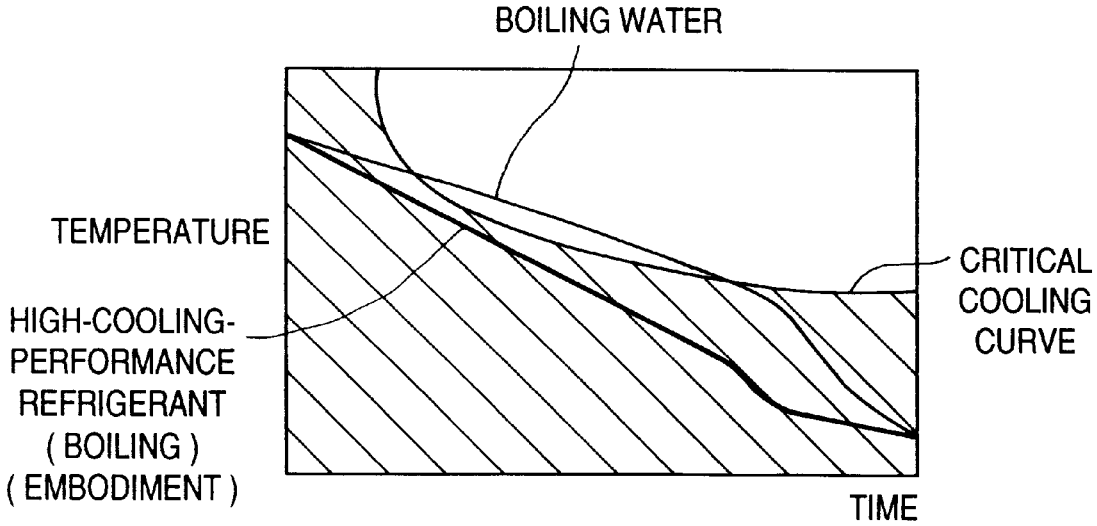
FIG. 6 is a graph showing the work cooling rate in hardening according to the second heat treatment method.

To raise the cooling rate in the film boiling state of the refrigerant, an aqueous solution containing sodium ions, e.g., an aqueous solution of sodium chloride (NaCl) or an aqueous solution of sodium carbonate ($Na_2Co_3$) may be used as a refrigerant having high cooling performance, and this refrigerant may be boiled to cool the work. In this case as well, as shown in FIG. 6, since the cooling rate in the film boiling state of the refrigerant becomes high, a cooling rate higher than the critical cooling rate can be maintained.

[Third Heat Treatment Method]

Figure 7A:
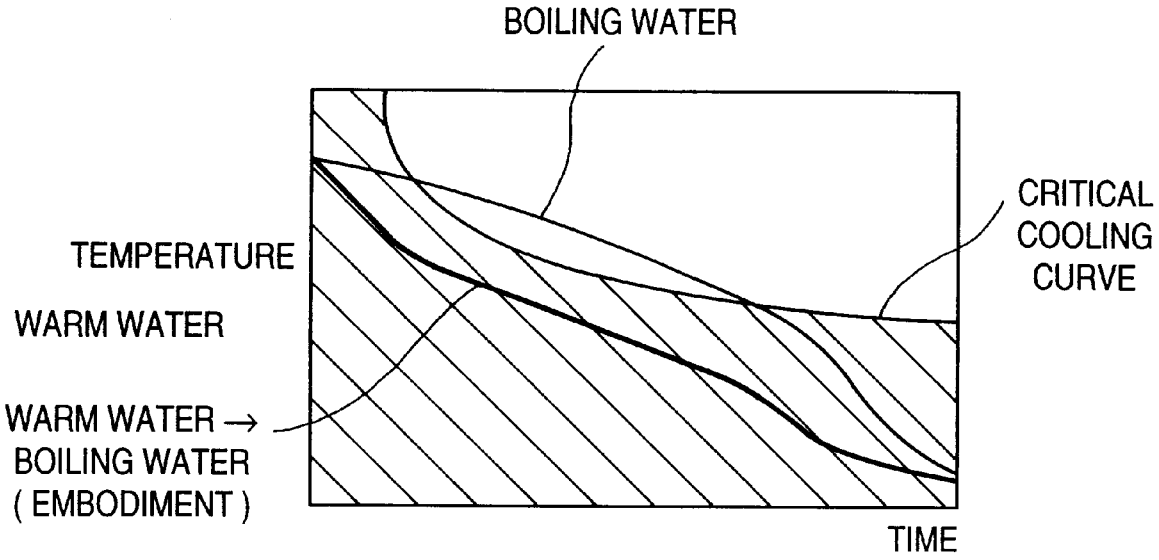
FIG. 7A is a graph showing the work cooling rate in hardening according to the third heat treatment method.
Figure 7B:
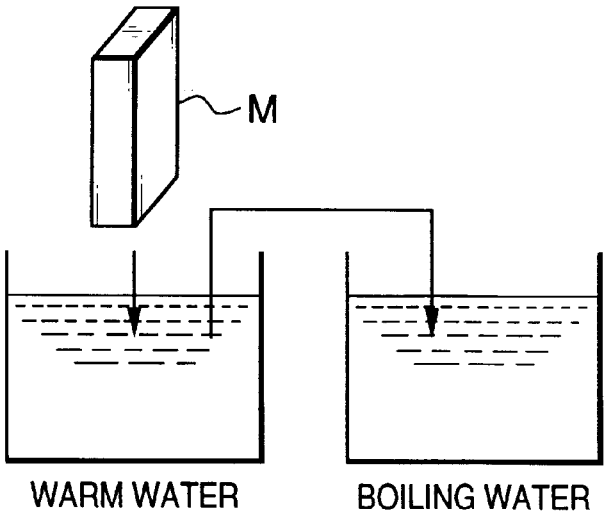
FIG. 7B is a view for explaining the third heat treatment method.

In this embodiment, to raise the cooling rate at the initial stage of hardening, the work M is cooled by warm water (before boil) which has a high cooling rate in the film boiling state at the initial stage of hardening and subsequently cooled by boiling water, as shown in FIG. 7B. The temperature of warm water is preferably about 60° C. to 90° C. The reason for this is as follows. When the temperature is lower than 60° C., the film boiling state ends in a short time. When the temperature is higher than 90° C., the cooling rate in the film boiling state is low. The temperature of boiling water is preferably the boiling temperature to a temperature corresponding to (boiling temperature −5° C.). In this case as well, since the cooling rate in the film boiling state of the refrigerant becomes high, a cooling rate higher than the critical cooling rate can be maintained, as shown in FIG. 7A.

[Fourth Heat Treatment Method]

Figure 8:
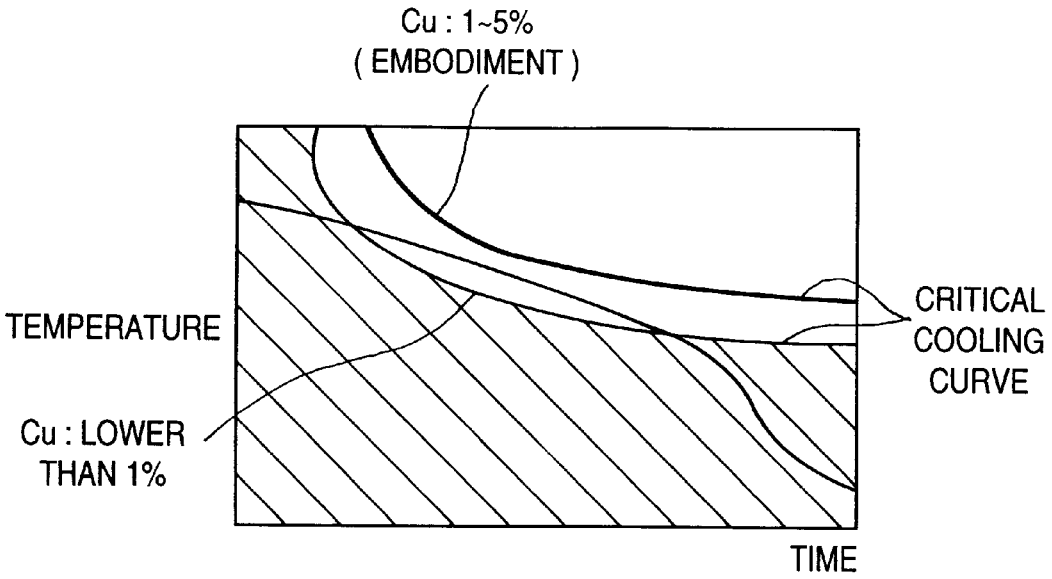
FIG. 8 is a graph showing the work cooling rate in hardening according to the fourth heat treatment method.
Figure 9:
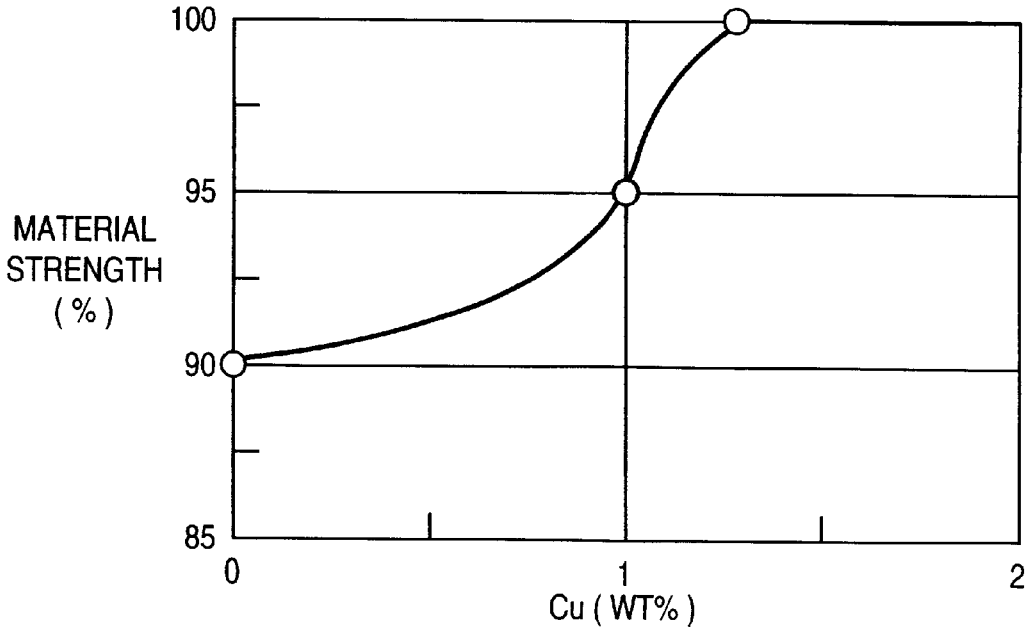
FIG. 9 is a graph showing the work material strength when the copper content is changed in the fourth heat treatment method.

To extend the lower limit of the critical cooling rate, the copper content when an aluminum-alloy casting is used as the work is set within the range of approximately 1 wt % to 5 wt %. This is because when the copper content is lower than 1 wt %, the sensitivity in hardening increases; the work cooling rate becomes lower than the critical cooling rate, resulting in a low material proof strength, as shown in FIGS. 8 and 9.

[Fifth Heat Treatment Method]

A work such as a cylinder head having a complex shape locally has a thin portion or a projecting portion. Such a portion cools down at a rate high than that for the remaining portions. For this reason, the film boiling state can hardly be maintained and residual stress is readily generated in such portion. Even for the thin portion or projecting portion where the film boiling state is hard to maintain, the film boiling of the refrigerant can be forcibly maintained to largely reduce the residual stress.

Figure 10:
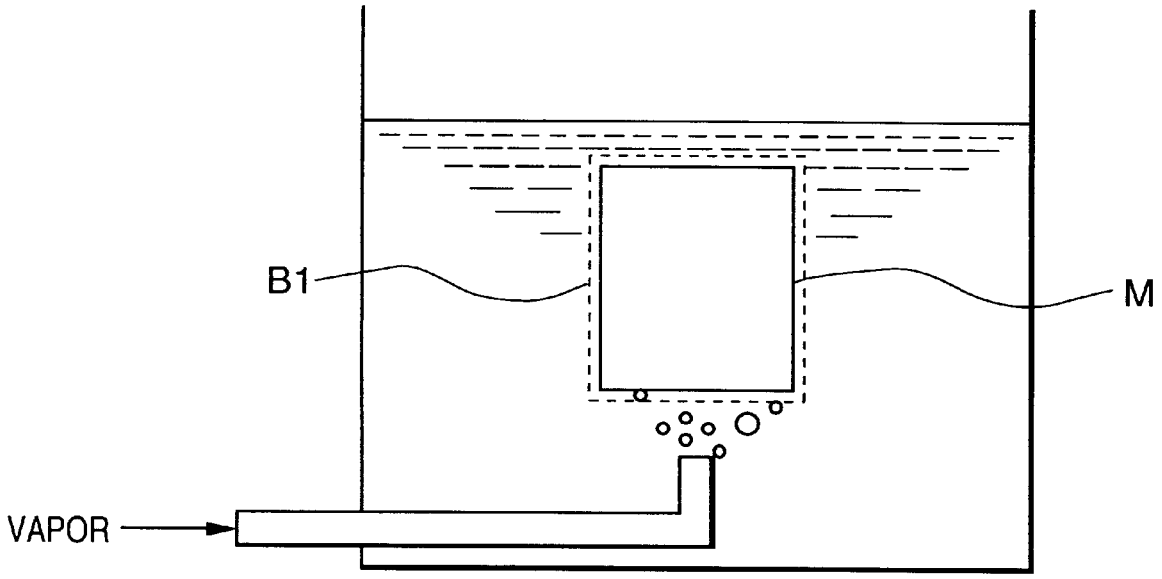
FIG. 10 is a view for explaining the fifth heat treatment method.

To forcibly maintain film boiling, vapor is sprayed from the lower side of the work M which is being cooled in hardening, as shown in FIG. 10. The vapor film B1 can be formed around the work M by this vapor.

As described above, the film boiling state can be maintained for a thin portion or a projecting portion.

[Sixth Heat Treatment Method]

Figure 11A:
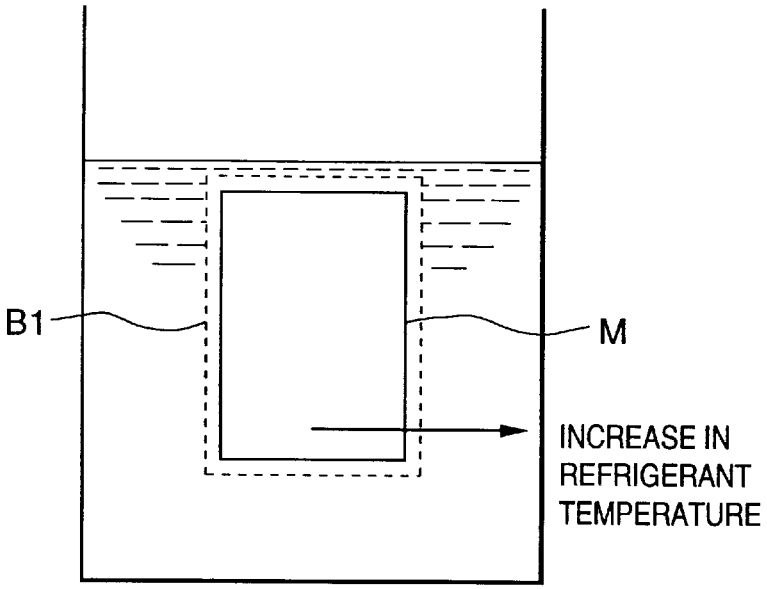
FIG. 11A is a view for explaining a heat treatment of a single work as a comparative example of the sixth heat treatment method.
Figure 11B:
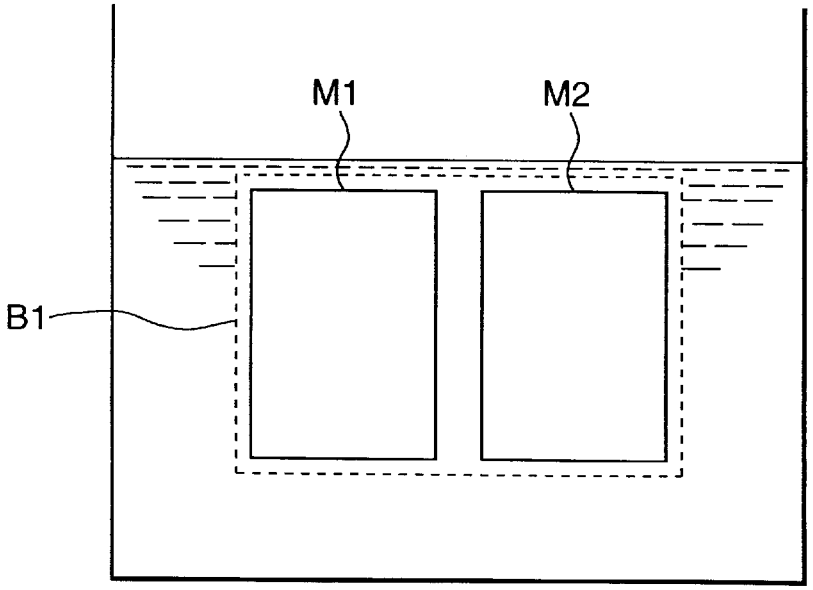
FIG. 11B is a view for explaining the sixth heat treatment method.

As a method of forcibly continuing film boiling, as shown in FIG. 11B, at least two works M1 and M2 are placed in the refrigerant next to each other, and a common vapor film is formed at the opposing portions of the two works in hardening. Continuous bubbles (vapor film) can be maintained around the works by the common vapor film.

As shown in FIG. 11A, when a single work is put in the refrigerant, heat of the work is consumed not only in generating the vapor film B1 but also in heating the refrigerant around the vapor film B1. To the contrary, when at least two works M1 and M2 are placed next to each other, as shown in FIG. 11B, heat of the works is primarily consumed in generating a vapor film between the adjacent works, and a vapor film B1 can be easily maintained around the works. In this case, a number of works are preferably set next to each other. A heated dummy work may be placed next to the work.

[Test 1]

Figure 12:
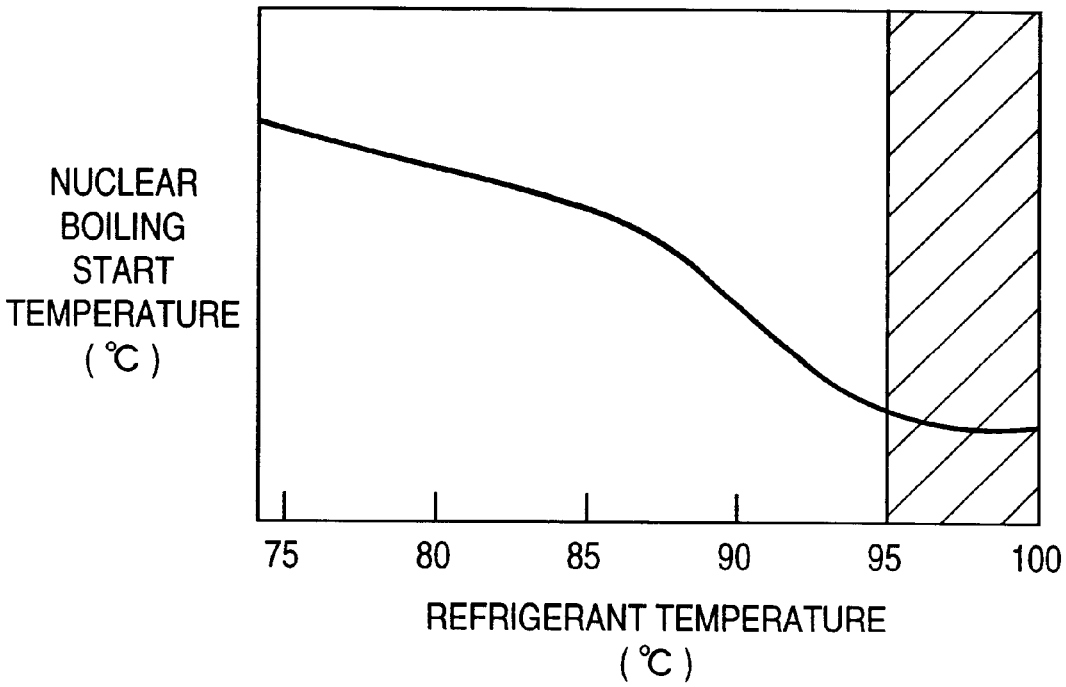
FIG. 12 is a graph showing the relationship between the refrigerant temperature and the nuclear boiling start temperature of the refrigerant.
Figure 13A:
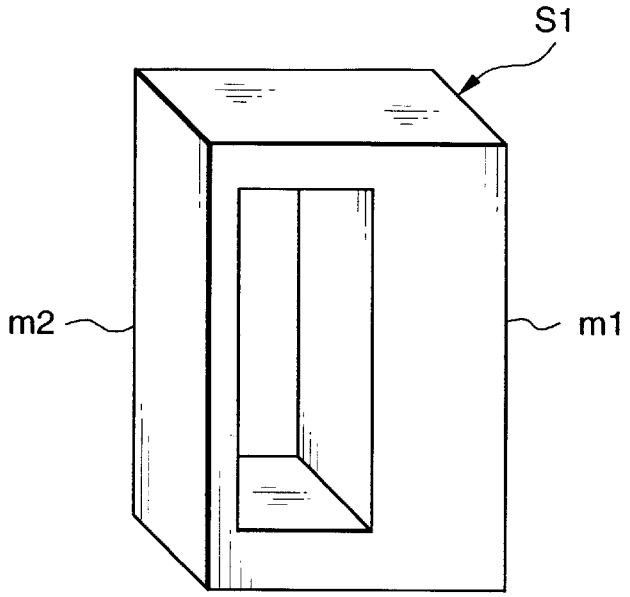
FIG. 13A is a view showing the shape of a test piece used for Test 1.
Figure 13B:
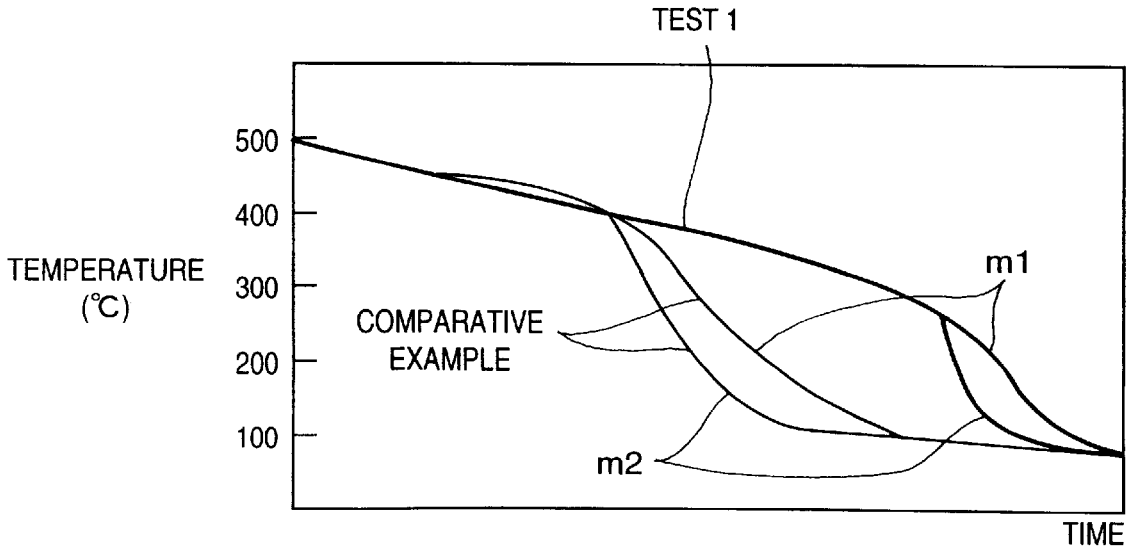
FIG. 13B is a graph showing the cooling rates for thick and thin portions of a work under the condition of Test 1.
Figure 14:
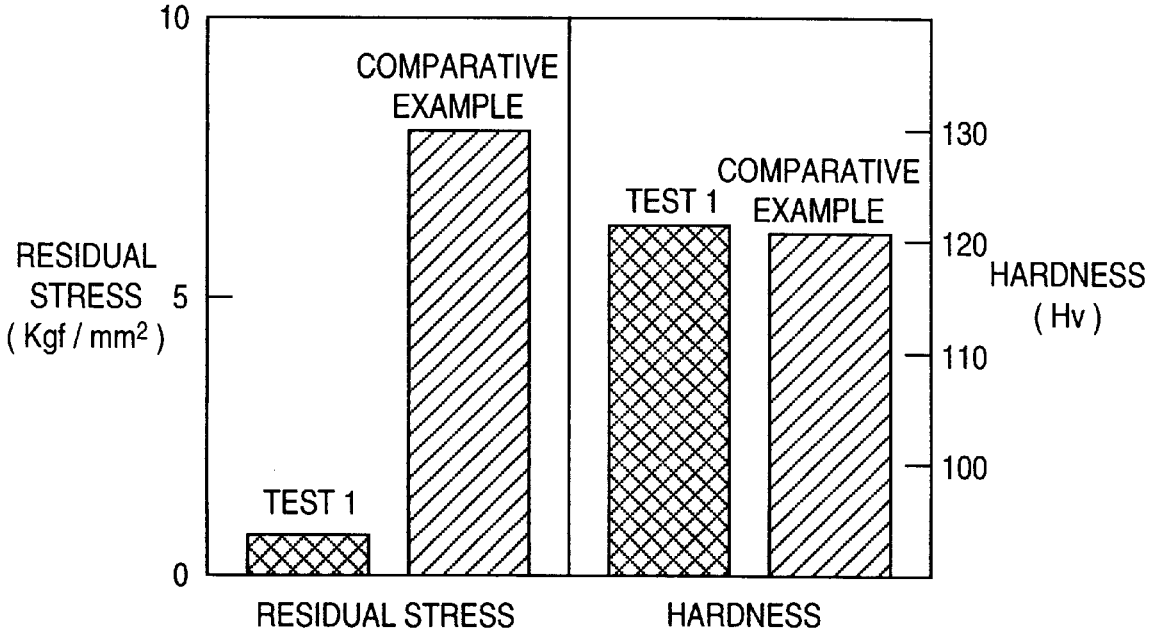
FIG. 14 is a graph showing the measurement results for the residual stress and hardness of the work hardened under the condition of Test 1.

FIG. 12 is a graph showing the relationship between the refrigerant temperature and the nuclear boiling start temperature of the refrigerant. FIG. 13A shows the shape of a test piece used for Test 1. FIG. 13B is a graph showing the cooling rates for a thick portion and a thin portion of a work under the condition of Test 1. FIG. 14 is a graph showing the measurement results of the residual stress and hardness of the work hardened under the condition of Test 1.

The condition of Test 1 is associated with the first heat treatment method. A test casting S1 consisting of an aluminum alloy having a thick portion m1 and a thin portion m2 shown in FIG. 13A was heated to 535° C., held at this temperature for 4 hrs, and hardened using boiling water at 99° C. as a refrigerant (melt processing). The nuclear boiling start temperature in this melt processing was 290° C. Since, in water at the boiling temperature or near the temperature, most heat of the casting is consumed as evaporation latent heat of water, a film boiling state of water continues for a long time, and the nuclear boiling start temperature lowers. To lower the nuclear boiling start temperature to a temperature at which the proof strength of the material exceeds thermal stress, the refrigerant temperature is preferably set within the range of boiling temperature to (boiling temperature −5° C.), as shown in FIG. 12.

After hardening, the test casting Si was heated to 180° C., held at this temperature 6 hrs, and air-cooled (artificial aging), the residual stress of the casting was ±2 kgf/mm$^2$ or less, as shown in FIGS. 13B and 14, i.e., hardly any residual stress was generated.

As a comparative example of Test 1, the same test casting Si was hardened using warm water at 75° C. In this case, the nuclear boiling start temperature was about 400° C. When nonboiling water is used, heat of the casting is consumed not only as evaporation latent heat of water but also in increasing the water temperature, so the film boiling state of the refrigerant is hard to maintain. In addition, a high level of residual stress, about 8 kgf/mm$^2$, was produced in the test casting S1 of the comparative example. The effect of the first heat treatment method is apparent from comparison between Test 1 and the comparative example.

[Test 2]

Figure 15A:
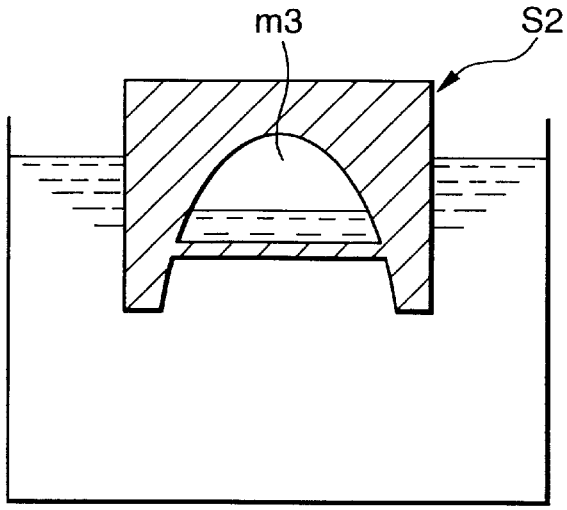
FIG. 15A is a view showing a shape of a test casting having a hollow portion under a condition of Test 2.
Figure 15B:
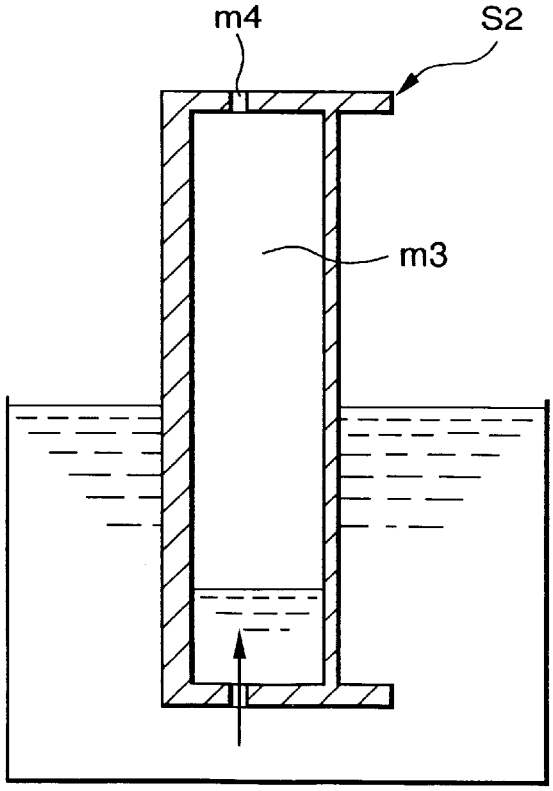
FIG. 15B is a view showing a shape of a test casting having a hollow portion and through holes under a condition of Test 2.

FIGS. 15A and 15B are views showing the shape of a test casting under the condition of Test 2.

As shown in FIGS. 15A and 15B, the condition of Test 2 is also associated with the first heat treatment method. A test casting S2 having a hollow portion m3 and through holes m4 communicating with the interior of the casting was used and subjected to a heat treatment under the condition of Test 1. Under the condition of Test 2 as well, hardly any residual stress was generated. Even when the casting had the hollow portion m3 and the through holes m4, the nuclear boiling start temperature lowered due to the same reason as that in Test 1. In addition, since the refrigerant temperature did not change between the hollow portion m3 where the refrigerant slowly circulated and the outer portion where the refrigerant quickly circulated, hardly any temperature difference was generated between the hollow portion m3 and the outer portion.

As a comparative example of Test 2, a nonboiling refrigerant was used. In this case, since the refrigerant temperature readily rises at the hollow portion m3, a temperature difference is easily generated between the hollow portion m3 and the outer portion.

[Test 3]

Figure 16A:
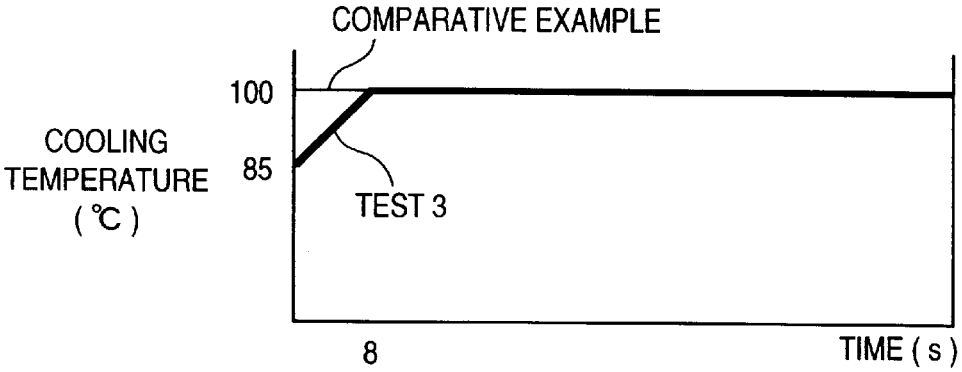
FIG. 16A is a graph showing a change in refrigerant temperature under the condition of Test 3.
Figure 16B:
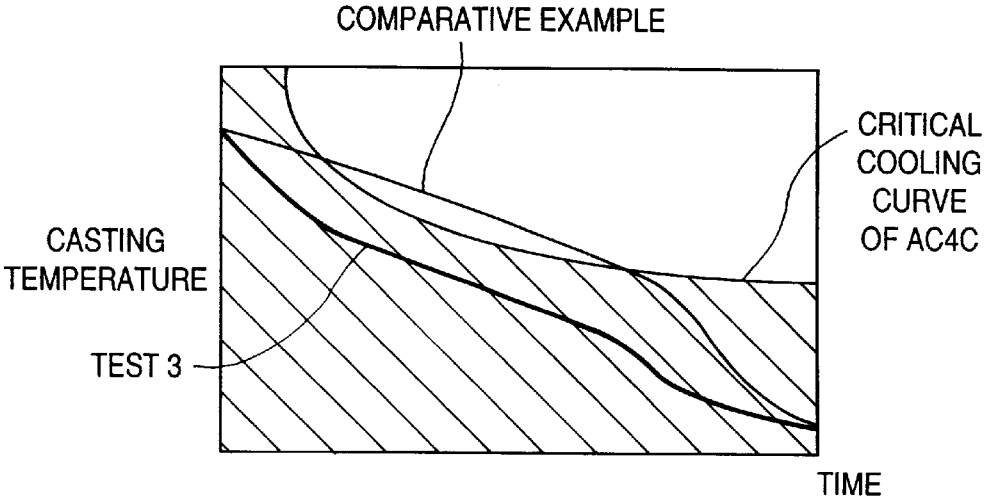
FIG. 16B is a graph showing the cooling rate of a casting in Test 3.

FIGS. 16A and 16B are graphs showing a change in refrigerant temperature and the cooling rate of a casting under the condition of Test 3.

The condition of Test 3 is also associated with the first heat treatment method. As a test casting, an aluminum-alloy casting AC4C complying with JIS and weighing 17 kg was heated to 525° C., held at this temperature for 4 hrs, and subjected to melt processing. After this, the casting was hardened using 100 liters of warm water at an initial temperature of 85° C. As shown in FIGS. 16A and 16B, the refrigerant temperature increased to 99° C. 8 seconds after the start of hardening and did not change until hardening was complete.

After hardening, the test casting was heated to 180° C., held at this temperature for 6 hrs, and air-cooled (artificial aging). The casting had residual stress of ±2 kgf/mm$^2$, and a satisfactory hardness, i.e., Vickers hardness of Hv 108.

As a comparative example of Test 3, the same test casting was hardened in 100 liters of boiling water and subjected to artificial aging under the same condition. In this case, hardly any residual stress was generated, though the Vickers hardness dropped to Hv 100.

[Test 4]

The condition of Test 4 is associated with the second heat treatment method. As a test casting, an aluminum-alloy casting AC4C complying with JIS was heated to 525° C., held at this temperature for 4 hrs, and subjected to melt processing.

After this, the casting was hardened using a boiling, 10% aqueous sodium chloride solution as a refrigerant.

After hardening, the test casting was heated to 180° C., held at this temperature for 6 hrs, and air-cooled (artificial aging). The cooling rate in the film boiling state increased as shown in FIG. 6, so the test casting was cooled at a rate higher than the critical cooling rate. The casting had residual stress of ±2 kgf/mm$^2$ or less, and a satisfactory Vickers hardness of Hv 110.

As a comparative example of Test 4, the same test casting was hardened in boiling water and subjected to artificial aging under the same condition. In this case, hardly any residual stress was generated, though the Vickers hardness decreased to Hv 100.

[Test 5]

The condition of Test 5 is associated with the third heat treatment method. As a test casting, an aluminum-alloy casting AC4C complying with JIS was heated to 525° C., held at this temperature for 4 hrs, and subjected to melt processing. After this, the casting was hardened for 10 sec using warm water at 75° C. as a refrigerant and continuously hardened in boiling water.

After hardening, the casting was heated to 180° C., held at this temperature for 6 hrs, and air-cooled (artificial aging). The cooling rate in the film boiling state increased as shown in FIG. 7, so the test casting was cooled at a rate higher than the critical cooling rate. Hardly any residual stress was generated in the casting, and a satisfactory Vickers hardness of Hv 110 was obtained.

As a comparative example of Test 5, the same test casting was hardened in boiling water and subjected to artificial aging under the same condition. In this case, again hardly any residual stress was generated, though the Vickers hardness dropped to Hv 100.

[Test 6]

The condition of Test 6 is associated with the fourth heat treatment method. As a test casting, an aluminum-alloy casting AC4C complying with JIS and containing 1.3 wt % copper was heated to 535° C., held at this temperature for 4 hrs, and subjected to melt processing. After this, the casting was hardened using warm water at 20° C. as a refrigerant.

After hardening, the test casting was heated to 180° C., held at this temperature for 6 hrs, and air-cooled (artificial aging). A satisfactory Vickers hardness of Hv 137 was obtained.

As a comparative example of Test 6, an aluminum-alloy casting AC4C containing no copper was hardened in warm water at 20° C. and subjected to artificial aging under the same condition. The casting had a Vickers hardness of Hv 110. However, when the casting was hardened in boiling water, its Vickers hardness decreased to Hv 98, as shown in FIG. 9.

In the comparative example of Test 6, when the casting was hardened in boiling water, hardly any residual stress was generated. However, in the comparative example, when the casting was hardened in water at room temperature, residual stress of about 10 kgf/mm$^2$ was generated.

[Test 7]

Figure 17A:
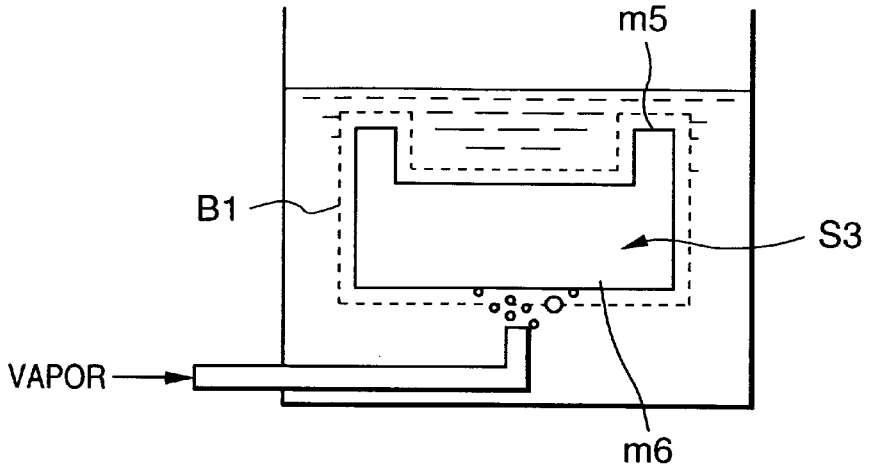
FIG. 17A is a view showing the condition of Test 7.
Figure 17B:
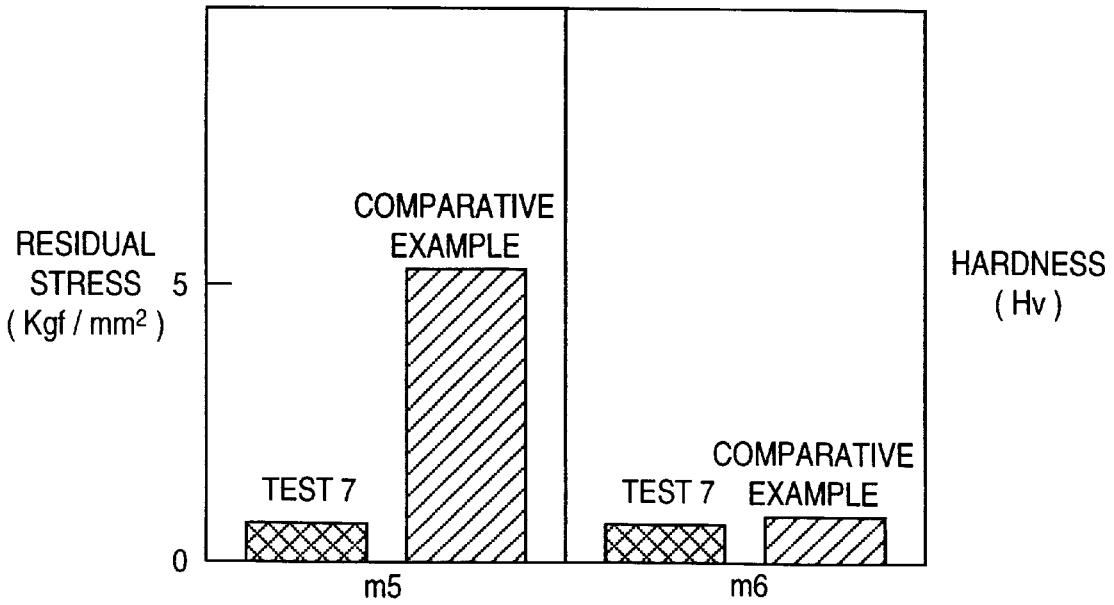
FIG. 17B is a graph showing the measurement results for the residual stress and hardness of the work hardened under the condition of Test 7.
Figure 17C:
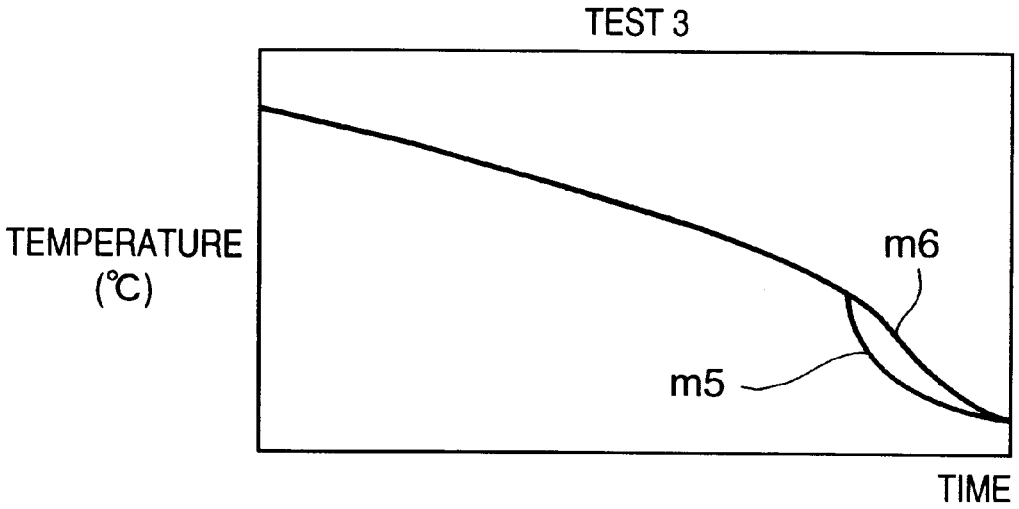
FIG. 17C is a graph showing the cooling rates of projecting and remaining portions of a test casting under the condition of Test 7.
Figure 17D:
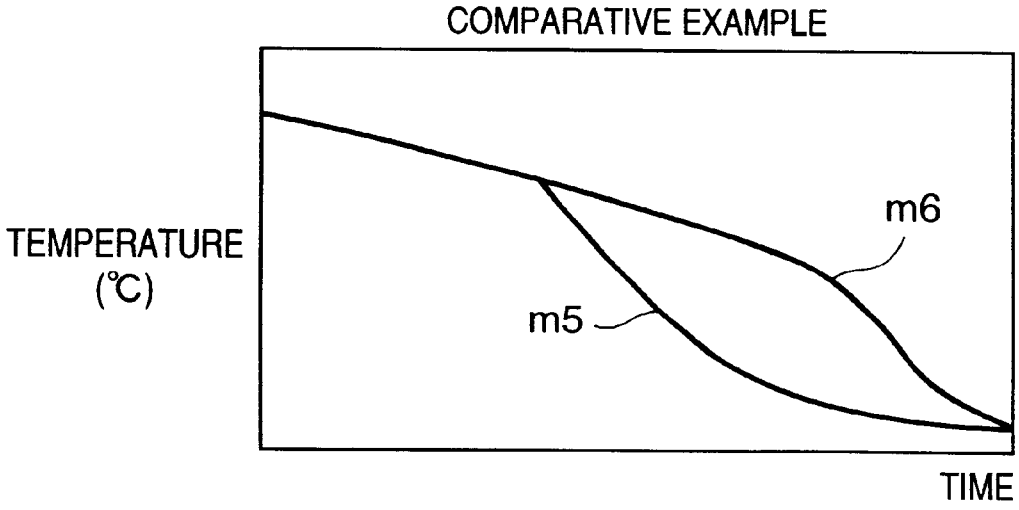
FIG. 17D is a graph showing the measurement results for the residual stress of a test casting as a comparative example of Test 7.

FIG. 17A is a view showing the condition of Test 7. FIG. 17B is a graph showing the result of the residual stress and hardness of a test casting hardened under the condition of Test 7. FIG. 17C is a graph showing the cooling rates of projecting and remaining portions of the test casting under the condition of Test 7. FIG. 17D is a graph showing the measurement results for the residual stress of a test casting as a comparative example of Test 7.

The condition of Test 7 is associated with the fifth heat treatment method. As a test casting S3, an aluminum-alloy casting AC4C complying with JIS and having a projecting portion m5 and a remaining portion m6 was heated to 535° C., held at this temperature for 4 hrs, and subjected to melt processing. After this, the test casting S3 in boiling water as a refrigerant was hardened while vapor at 140° C. was supplied from the lower portion of the test casting S3 in an amount of about 3 kg/min.

The cooling rates for the projecting portion m5 and the remaining portion m6 of the test casting S3 during hardening almost equaled each other. After hardening, this test casting was heated to 180° C., held at this temperature for 6 hrs, and air-cooled (artificial aging). Hardly any residual stress was generated in the projecting portion m5 and the remaining portion m6, as shown in FIG. 17B.

As a comparative example of Test 7, the-same test casting S3 was hardened in boiling water without supplying vapor and subjected to artificial aging under the same condition. As shown in FIG. 17D, the film boiling state of the projecting portion m5 ended earlier than that of the remaining portion m6, and the residual stress was about 5 kgf/mm$^2$.

[Test 8]

Figure 18:
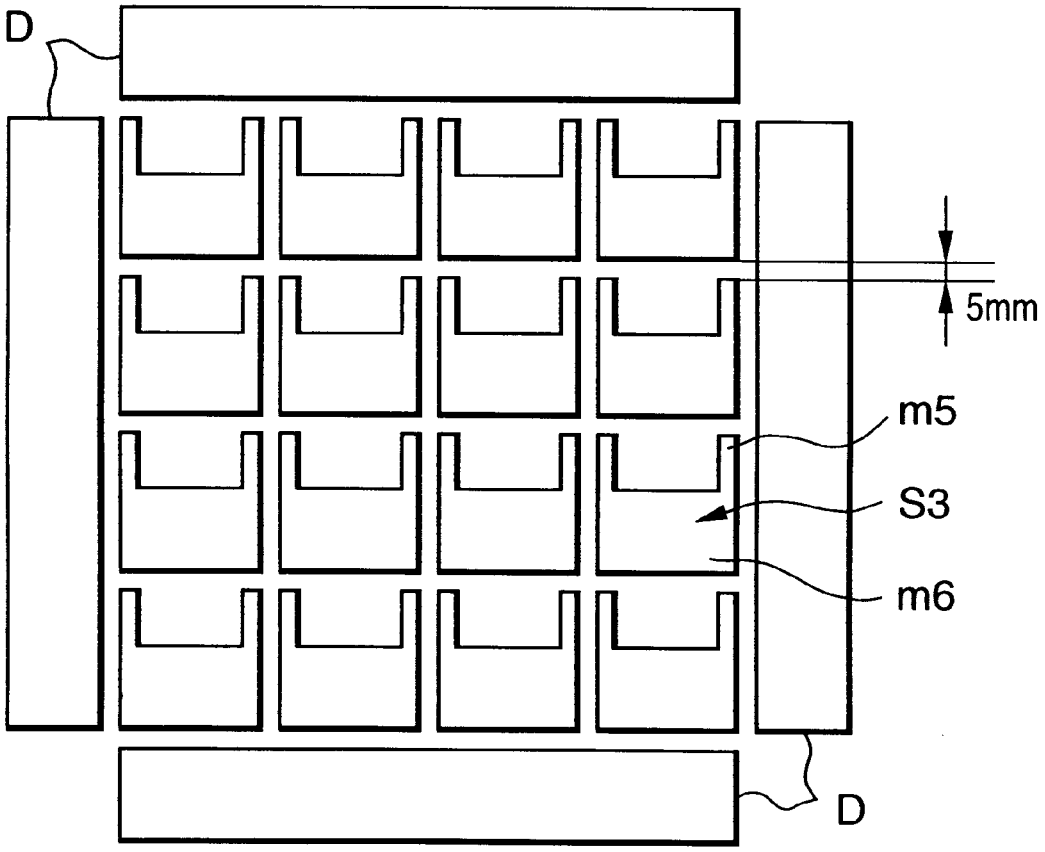
FIG. 18 is a view showing the condition of Test 8.

FIG. 18 is a view showing the condition of Test 8. As the same test casting S3 as that of Test 7, an aluminum-alloy casting AC4C complying with JIS and having a projecting portion m5 and a remaining portion m6 was heated to 535° C., held at this temperature for 4 hrs, and subjected to melt processing. After this, as shown in FIG. 18, 16 test castings S3 were put in the refrigerant next to each other at an intervals of about 5 mm, heated dummy members D were placed around the test castings S3, and the test castings were hardened in boiling water.

The cooling rates for the projecting portion m5 and the remaining portion m6 of the test casting S3 during hardening almost equaled each other. After hardening, this test casting was heated to 180° C., held at this temperature for 6 hrs, and air-cooled (artificial aging). Hardly any residual stress was generated in the projecting portion m5 and the remaining portion m6.

As a comparative example of Test 8 the same test casting S3 was hardened in boiling water without supplying vapor and subjected to artificial aging under the same condition. The film boiling state of the projecting portion m5 ended earlier than that of the remaining portion m6, and the residual stress was about 5 kgf/mm$^2$.

As described above, according to this embodiment, the film boiling state of the refrigerant is maintained at least to a temperature at which the proof strength of the material exceeds thermal stress is reached. With this arrangement, any residual stress produced in a heat treatment can be reduced without impairing the material proof strength.

The present invention is not limited to the above embodiments and various changes and modifications can be made within the spirit and scope of the present invention. Therefore, to apprise the public of the scope of the present invention, the following claims are made.

What is claimed is:

1. A light-alloy casting heat treatment method, comprising:

heating the light-alloy casting to a predetermined hardening temperature to provide a heated light-alloy casting;

cooling the heated light-alloy casting in a refrigerant to provide a cooled light-alloy casting;

heating the refrigerant around the cooled light-alloy casting to a film boiling state;

supplying vapor from a lower portion of the light-alloy casting to maintain the film boiling state of the refrigerant at least at a temperature at which a proof strength of the casting exceeds thermal stress, wherein at least two castings are placed next to each other in the refrigerant.

2. The method according to claim 1, further comprising cooling the casting at a rate higher than a critical cooling rate of the casting.

3. The method according to claim 2, wherein an initial temperature and amount of the refrigerant is set to make the refrigerant undergo a change from a nonboiling state to a boiling state by heat of the casting itself.

4. The method according to claim 3, wherein the casting is cooled by the refrigerant before boiling and then cooled by boiling water.

5. The method according to claim 4, wherein a temperature of the boiling water is set within a range of a boiling temperature to (boiling temperature −5° C.).

6. The method according to claim 2, wherein the refrigerant is warm water at substantially 60° C. to 90° C.

7. The method according to claim 1, wherein the refrigerant comprises an aqueous solution containing sodium ions.

8. The method according to claim 7, wherein the refrigerant comprises one of an aqueous solution of sodium chloride or an aqueous solution of sodium carbonate having high cooling performance.

9. The method of claim 1, further comprising supplying vapor from a lower portion of the casting in the refrigerant.

10. The method according to claim 2, wherein the casting comprises an aluminum-alloy casting containing substantially 1 to 5 wt % of copper.

11. A light-alloy casting heat treatment method, comprising:

heating the light-alloy casting to a predetermined hardening temperature to provide a heat light-alloy casting;

cooling the heated light-alloy casting in a refrigerant to provide a cooled light-alloy casting;

heating the refrigerant around the cooled light-alloy casting to a film boiling state; and supplying vapor from a lower portion of the light-alloy casting to maintain the film boiling state of the refrigerant at least at a temperature at which a proof strength of the casting exceeds thermal stress.

* * * * *

UNITED STATES PATENT AND TRADEMARK OFFICE

CERTIFICATE OF CORRECTION

PATENT NO. : 6,214,136 B1
DATED : April 10, 2001
INVENTOR(S) : Kazuyuki Yoshimoto et al.

It is certified that error appears in the above-identified patent and that said Letters Patent is hereby corrected as shown below:

Title page,
FOREIGN PATENT DOCUMENTS, change ".2 133 047" to -- 2 133 047 --.

Column 5,
Line 66, change "Si" to -- S1 --.

Column 6,
Line 5, change "Si" to -- S1 --;
Line 66, delete paragraph.

Column 8,
Line 13, after "the" delete "-".

Signed and Sealed this

Fourteenth Day of May, 2002

*Attest:*

*Attesting Officer*

JAMES E. ROGAN
*Director of the United States Patent and Trademark Office*